US012324499B2

(12) United States Patent
Masud

(10) Patent No.: US 12,324,499 B2
(45) **Date of Patent: *Jun. 10, 2025**

(54) HAND-HELD COSMETIC DISPENSER

(71) Applicant: Richard Masud, Pasadena, CA (US)

(72) Inventor: Richard Masud, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/615,408

(22) Filed: Mar. 25, 2024

(65) Prior Publication Data

US 2024/0237807 A1 Jul. 18, 2024

Related U.S. Application Data

(63) Continuation of application No. 17/736,703, filed on May 4, 2022, now Pat. No. 11,944,180.

(60) Provisional application No. 63/184,356, filed on May 5, 2021.

(51) Int. Cl.

| | |
|---|---|
| ***A45D 34/04*** | (2006.01) |
| ***B65D 83/285*** | (2025.01) |
| ***B65D 83/384*** | (2025.01) |
| ***B65D 83/66*** | (2006.01) |

(52) U.S. Cl.

CPC ..... *A45D 34/04* (2013.01); *B65D 83/285* (2013.01); *B65D 83/384* (2013.01); *B65D 83/66* (2013.01); *A45D 2200/057* (2013.01); *A45D 2200/10* (2013.01)

(58) Field of Classification Search

CPC ..... A45D 34/04; A45D 2200/057; A45D 2200/10; B65D 83/285; B65D 83/384; B65D 83/66; B65D 83/673; B65D 83/42; B65D 83/7532; B05B 9/0811; B05B 9/0833

See application file for complete search history.

(56) References Cited

U.S. PATENT DOCUMENTS 2,557,120 A * 6/1951 Knoblock ..... A62C 13/70 222/105
3,883,043 A * 5/1975 Lane ..... B67D 1/0412 222/399

(Continued)

FOREIGN PATENT DOCUMENTS

| | | |
|---|---|---|
| CN | 110193120 | 9/2019 |
| KR | 20140148209 | 12/2014 |
| KR | 102206300 | 1/2021 |

OTHER PUBLICATIONS

Temptu Air—Jan. 5, 2020. https://temptu.com/pro/air.html.

*Primary Examiner* — Bob Zadeh

(74) *Attorney, Agent, or Firm* — Concourse Law Group; Katherine B. Sales, Esq.

(57) ABSTRACT

A hand-held cosmetic dispenser having a housing with a first end and a second end, the housing having a nozzle coupled to a first end of the housing, a power source disposed within the housing, a spray button coupled to the housing, a cosmetic fluid compartment disposed within the housing and configured to receive and retain a fluid cosmetic, a gas compartment configured to receive and retain a gas cannister, and a gas controlling system disposed within the housing. The gas controlling system having a control mechanism that controls how much gas can leave the gas cannister. The power source is electrically coupled to the spray button and the gas controlling system. A method of using the same.

20 Claims, 4 Drawing Sheets

(56) References Cited

U.S. PATENT DOCUMENTS

| | | | | |
|---|---|---|---|---|
| 4,446,990 | A * | 5/1984 | Stevenson | F41H 9/10 222/398 |
| 4,714,084 | A | 12/1987 | Berry et al. | |
| 5,139,179 | A * | 8/1992 | Cecil | B67D 1/0885 222/400.7 |
| 5,476,192 | A * | 12/1995 | Julinot | B65D 83/22 116/DIG. 44 |
| 8,757,516 | B2 | 6/2014 | Spiegel et al. | |
| 10,098,434 | B2 * | 10/2018 | Nishiura | A45D 34/04 |
| 10,264,868 | B2 | 4/2019 | Federov | |
| 10,265,716 | B2 | 4/2019 | Lee | |
| 11,944,180 | B1 * | 4/2024 | Masud | B05B 9/0811 |
| 2004/0222315 | A1 | 11/2004 | Habatjou | |
| 2006/0027604 | A1 * | 2/2006 | Puzio | B05C 17/0146 222/263 |
| 2006/0043120 | A1 * | 3/2006 | Campbell | G01F 11/026 222/386.5 |
| 2009/0212133 | A1 | 8/2009 | Collins, Jr. | |
| 2014/0050515 | A1 * | 2/2014 | Bruder | A45D 34/04 401/186 |
| 2015/0014433 | A1 | 1/2015 | Albert et al. | |
| 2015/0166251 | A1 * | 6/2015 | Jones | B65D 83/62 222/389 |
| 2019/0015857 | A1 * | 1/2019 | Gouchtchina | A61M 35/003 |
| 2019/0076860 | A1 | 3/2019 | Seeberger | |
| 2020/0316270 | A1 * | 10/2020 | Dijkstra | A61M 3/0204 |
| 2020/0376511 | A1 | 12/2020 | Zhu | |
| 2024/0237807 | A1 * | 7/2024 | Masud | B65D 83/384 |

* cited by examiner

HAND-HELD COSMETIC DISPENSER

CROSS-REFERENCE TO RELATED APPLICATIONS

This application is a continuation of U.S. Non-Provisional patent application Ser. No. 17/736,703, titled "Hand-Held Cosmetic Dispenser," filed May 4, 2022, which claims priority to U.S. Provisional Patent App. No. 63/184,356, titled "Hand-Held Cosmetic Dispenser," filed May 5, 2021, the contents of which are incorporated by reference herein in their entirety.

BACKGROUND

Air-brushed and/or spray on cosmetics are desirable because they can be applied more evenly and precisely than the traditional methods of applying make-up that include sponges and/or brushes. However, the spray-on applicators of the prior art are relatively large and tend to require an external gas and/or power source. This makes them difficult to carry in a purse and utilize for re-application while the user is on the go.

Accordingly, there is a need for a hand-held, compact, cosmetic dispenser.

SUMMARY

The present invention addresses that need. The present invention is directed to a hand-held cosmetic dispenser comprising a housing having a first end and a second end and comprising: a nozzle coupled a first end of the housing; a power source disposed within the housing; a spray button coupled to the housing; a cosmetic fluid compartment disposed within the housing and configured to receive and retain a fluid cosmetic; a gas compartment configured to receive and retain a gas cannister; and a gas controlling system disposed within the housing.

The gas controlling system comprises an air-tight coupler configured for coupling to the gas cannister; a control mechanism that controls how much gas can leave the gas cannister; and a tube connecting the gas compartment to the cosmetic fluid compartment, and the power source is electrically coupled to the spray button and the gas controlling system.

The second end of the housing can comprises a removable end cap that permits insertion and removal of the gas cannister.

The power source can be a rechargeable lithium battery.

The nozzle can be removable and interchangeable and can further comprise a nozzle controller mechanically coupled to the nozzle.

Optionally, the dispenser can have a light disposed proximate the first end of the housing and a light button disposed along the housing and coupled the light and the power source.

Optionally, the cosmetic compartment comprises a fluid intake coupled thereto.

Optionally, cosmetic compartment is configured to receive the fluid cosmetic in a cosmetic cannister.

Optionally, the housing can comprise an upper portion and a lower portion that removably couple to each other, and the nozzle, power source, spray button, optional light and light button, and cosmetic fluid compartment are disposed along/within the upper portion of the housing, and the gas compartment and the gas controlling system are disposed within the lower portion of the housing.

The present invention is also directed to a method of using the dispenser. The method comprises steps of: providing the dispenser; separating the upper portion of the housing from the lower portion of the housing; inserting a cosmetic cannister into the upper portion of the housing; coupling the upper portion of the housing to the lower portion of the housing; removing end cap from the lower portion of the housing; inserting a gas cannister into the lower portion of the housing such that the air-tight coupler punctures the gas cannister; coupling the end cap to the lower portion of the housing; and pressing spray button and spraying cosmetic onto the surface the user desires to apply cosmetic.

The step of inserting the gas cannister into the lower portion of the housing can be performed before or after the step of inserting the cosmetic cannister into the upper portion of the housing.

An alternative method of using the dispenser comprises the steps of: pouring or squirting cosmetic into the cosmetic compartment; removing end cap from the housing; inserting a gas cannister into the housing such that the air-tight coupler punctures the cannister; coupling the end cap to the housing; and pressing spray button and spraying cosmetic onto the surface the user desires to apply cosmetic.

The step of inserting the gas cannister into the housing can be performed before or after the step of pouring or squirting the cosmetic into the cosmetic compartment.

DRAWINGS

These and other features, aspects, and advantages of the present invention will become better understood with regard to the following description, appended claims, and accompanying drawings.

DESCRIPTION

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Figure 1:
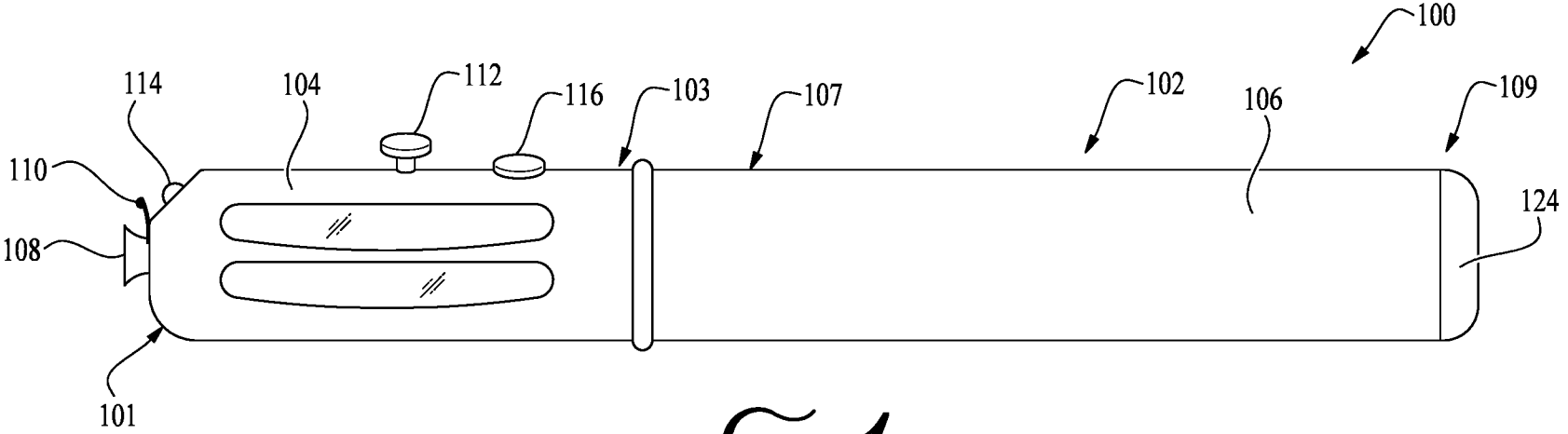
FIG. 1 is side elevation view of a first embodiment of a hand-held cosmetic dispenser having features of the present invention.
Figure 2:
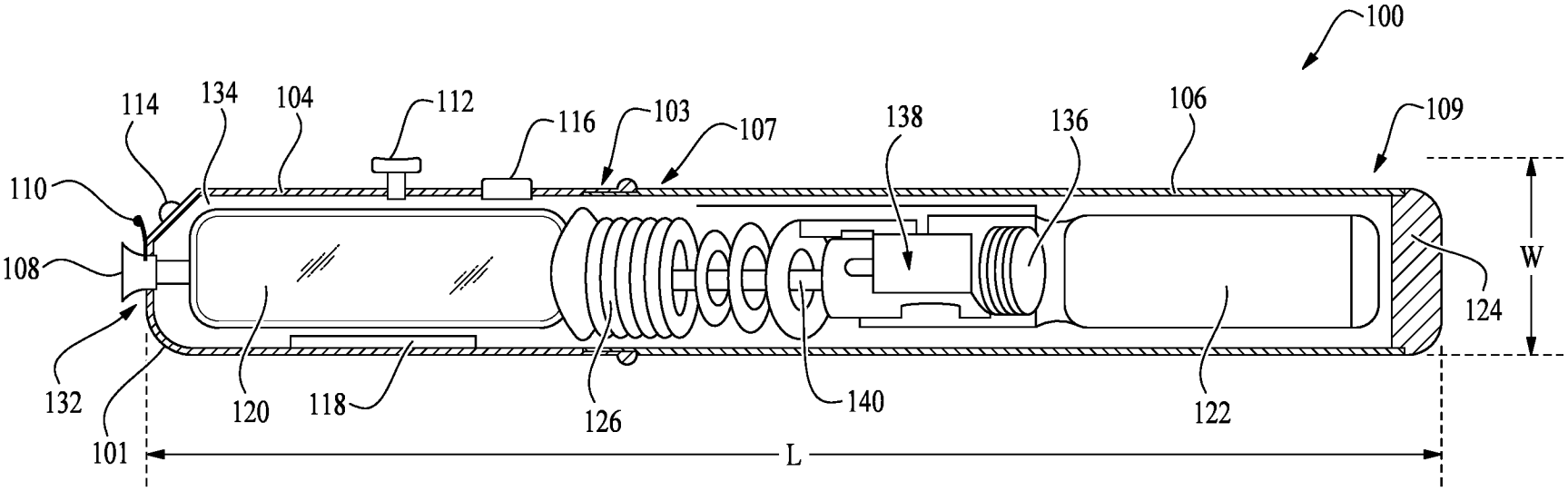
FIG. 2 is a sectional view of the cosmetic dispenser of FIG. 1 taken along line 2-2.
Figure 3:
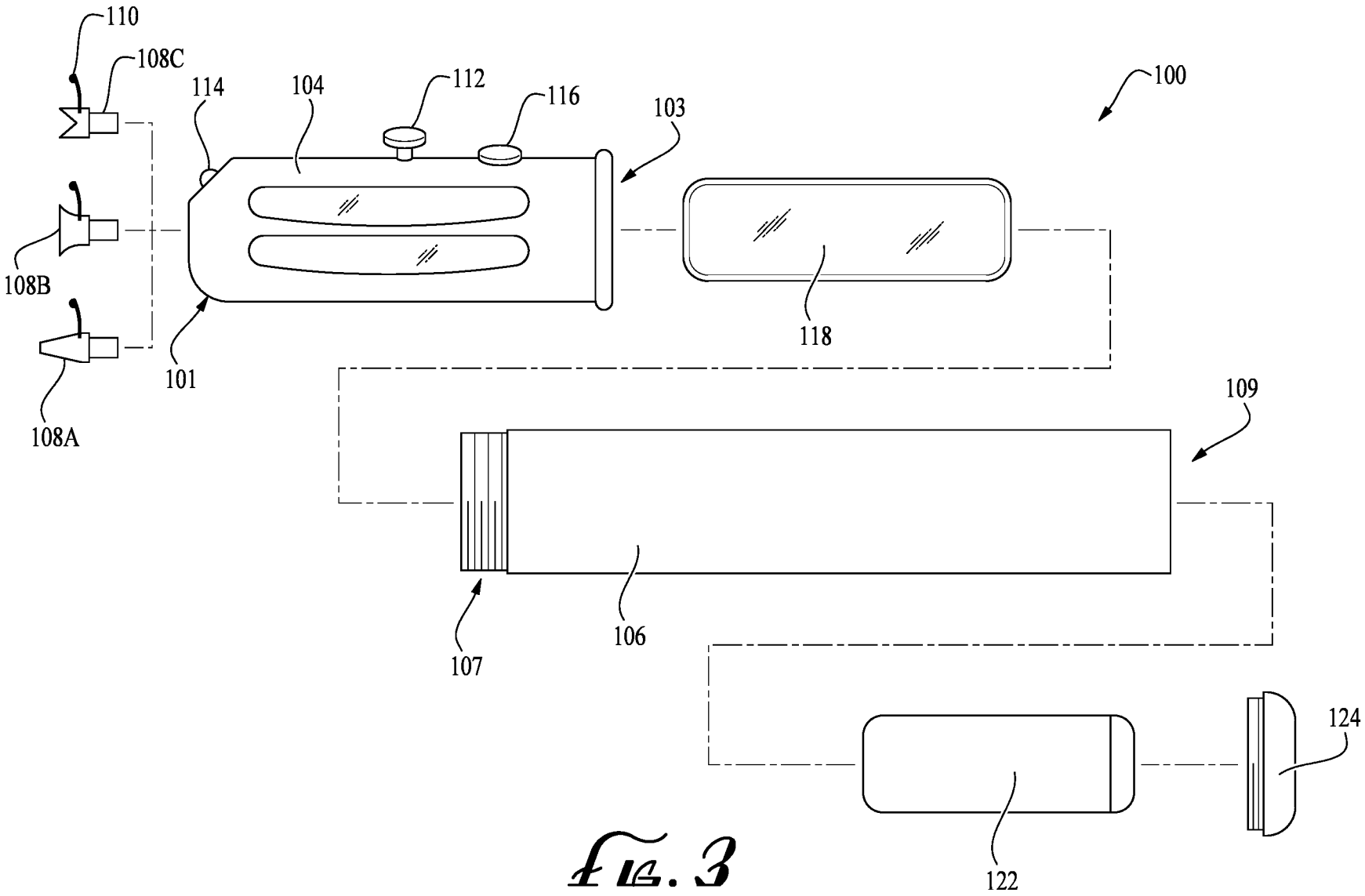
FIG. 3 is an exploded view of the cosmetic dispenser of FIG. 1.

Referring now to FIGS. 1 through 3, there is shown a first embodiment of a hand-held cosmetic dispenser 100 having features of the present invention. The cosmetic dispenser 100 comprises a housing 102 having an upper portion 104 and a lower portion 106 that removably couple together via treading, press fitting/friction fitting, or some other mechanical means. The dispenser 100/housing 102 can be can any shape, including but not limited to cylindrical, a rectangular prism, a triangular prism, or any other shape, and each opposed end of the dispenser 100/housing 102 can be any shape, including but not limited to rounded, curved, flat, or any other shape. The dispenser 100/housing 102 can be made from plastic, metal, composite material, or any combination of the same.

The dispenser 100 can be anywhere from three (3) to eight (8) inches long, and anywhere from about one (1) to three (3) inches in width. However, these are approximate measurements and are not limiting and the measurements of the dispenser 100 may vary.

The upper portion 104 of the housing 102 has two opposed ends 101, 103, a nozzle 108, a nozzle controller 110, a spray button 112, a light 114, a light button 116, a battery to power the light 118, and is configured to receive and retain a removable, replaceable, pre-filled cosmetic canister/container 120.

The lower portion 106 of the housing 102 has two opposed ends 107, 109 and is configured to receive and retain a removable, replaceable, canister/container of pre-pressurized gas 122 which can be inserted into the lower portion 106 of the housing 102 via a removable end cap 124 that removably couples to one end of the lower portion 106 of the housing 102. The lower portion 106 of the housing 102 also contains the gas controlling/dispensing system 126.

The nozzle 108 is coupled to the first end 101 of the upper portion 104 of the housing 102 and is the orifice through which cosmetic is dispensed. The nozzle 108 can be removable and interchangeable, as best shown in FIG. 3, and can come in a variety of different sizes and shapes, some nozzles 108A being narrower and therefore providing a narrow spray pattern, and other nozzles 108B being wider and therefore providing a wider spray pattern. This allows the user to achieve different flow patterns depending on their makeup application needs.

In this embodiment, the nozzle controller 110 is a lever that is mechanically coupled to the nozzle 108 and controls the flow of the cosmetic through the nozzle 108 by increasing or decreasing the size of the orifice in the nozzle 108 through which cosmetic can pass through. Thus, the flow of cosmetic through the nozzle 108 can be increased or decreased utilizing the controller 110.

The spray button 112 is disposed along the upper portion 104 of the housing and is electrically and/or mechanically coupled to the power source 118, and the gas dispensing system 126, which is discussed in greater detail below.

The light 114 is disposed along the first end 101 of the upper portion 104 of the housing 102 and is electrically coupled to the light button or switch 116 (also disposed along the upper portion 104 of the housing 102), and the light button 116 is electrically coupled to the power source (or battery) 118. The light button 116 can be an actuator. Pressing the light button 116 will turn the light 114 on and off, as desired by the user, and provides a light source for the user to use when applying the cosmetic.

Preferably, the power source 118 is a battery, and optionally, a lithium battery. Optionally the battery 118 is coupled to a port (not shown) which allows the battery 118 to be rechargeable via a USB or some other form of coupling. Optionally, the battery 118 is not rechargeable and is instead removable and replaceable.

As noted above, the upper portion 104 of the housing 102 is configured to receive and retain a cartridge or cannister of cosmetic 120, and the cartridge 120 can be inserted into the upper portion 104 of the housing 102 via open end 103. Opposite end 103 is end 101. End 101 comprises an orifice 132 through which the nozzle 108 can be inserted and thereby coupled to the cannister 120 therein. Open end 103 of the upper portion 104 of the housing 102 removably couples to open end 107 of the lower portion 106 of the housing 102.

The cartridge or cannister of cosmetic 120 resides in a cosmetic fluid compartment 134 in the upper portion 104 of the housing 102. The cannister 120 contains liquid cosmetic that can be dispensed by the dispenser 100, and when the cannister 120 is empty, or the user wishes to apply a different cosmetic, the user can remove the cannister 120 and replace it with a different cannister 120.

The gas controlling/dispensing system 124 is primarily located in the lower portion 106 of the housing 102. The gas system 124 comprises an air-tight coupler 136 that the gas cannister 122 couples to via an air-tight connection (preferably threads), where the coupler 136 also includes a means of puncturing the gas cannister 122 to release its gas contents, but at the same time maintains pressure in the gas cannister 122.

The coupler 136 is connected to control mechanism 138 that controls how much gas is released from the cannister 122 and into a tube 140. Tube 140 allows the gas to travel from the cannister 122 and into the cosmetic compartment 134. As the gas travels past the cosmetic cannister 120, cosmetic can leave the cannister and get pulled along by the gas and out through the nozzle 108. The spray button 112 is electrically and/or mechanically coupled to the control mechanism 138 such that depression of the button 112 controls the amount of gas permitted to leave the gas cannister 122 and enter the tube 140. The gas cannister 122 is pressurized, and can contain carbon dioxide, oxygen, or some combination of the same, such as normal atmospheric air. The gas cannister 122 functions as a pressurized propellant for pushing and spraying the cosmetic from the dispenser 100.

Figure 4:
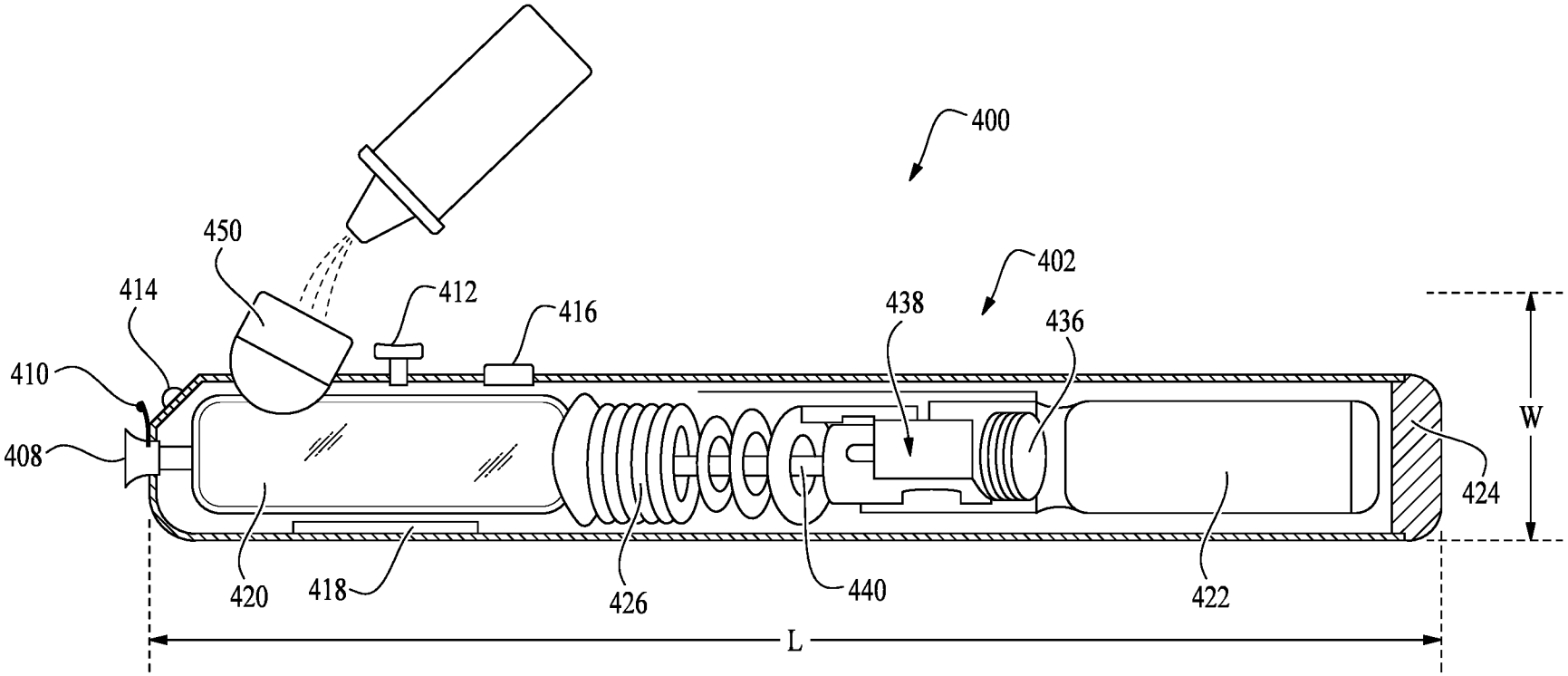
FIG. 4 is a sectional view of a second embodiment of a hand-held cosmetic dispenser shaving features of the present invention.

Referring now to FIG. 4, there is shown a second embodiment of a hand-held cosmetic dispenser 400 having features of the present invention. In this embodiment, the dispenser is configured to configured to receive a cosmetic in a liquid form. The cosmetic can be poured, squirted, funneled, introduced into the cosmetic compartment 420 via a fluid intake 450. This makes the cosmetic compartment 420 refillable by the user depending on the cosmetic they desire to use. The fluid intake 450 is closeable such that cosmetic cannot leak out of the intake 450.

Optionally, the intake 450 is removably coupled to the dispenser 400, such that, when a user desires to fill the cosmetic compartment 420, the user couples the intake 450 to the dispenser 400, introduces the cosmetic to the compartment 420 via the intake 450, and then when finished, removes the intake 450 from the dispenser 400.

The other notable difference between the first embodiment 100 and the second embodiment 400 is that the housing 402 of the second embodiment 400 is a one-piece housing. The housing 402 has a nozzle 408, a nozzle controller 410, a spray button 412, a light 414, a light button 416, a power source 418, and a gas controlling/dispensing system 426.

The housing 402 is configured to receive and retain a removable, replaceable, canister/container of pre-pressurized gas 422 which can be inserted into the housing 402 via a removable end cap 424 that removably couples to one end of the housing 402.

The spray button 412 is disposed along the housing 402 and is electrically and/or mechanically coupled to the gas dispensing system 426, which has an air-tight coupler 436 and a control mechanism 438 that controls how much gas is released from the cannister 122 and into a tube 440. Like the first embodiment 100, tube 440 allows the gas to travel from the cannister 422 and into the cosmetic compartment 434.

In this configuration, as the gas travels past through or near the cosmetic compartment 434, cosmetic can leave the compartment 434 and is pulled along by the gas and out through the nozzle 108. As in the first embodiment 100, depression of the button 412 controls the amount of gas permitted to leave the gas cannister 422 and enter the tube 440.

Figure 5:
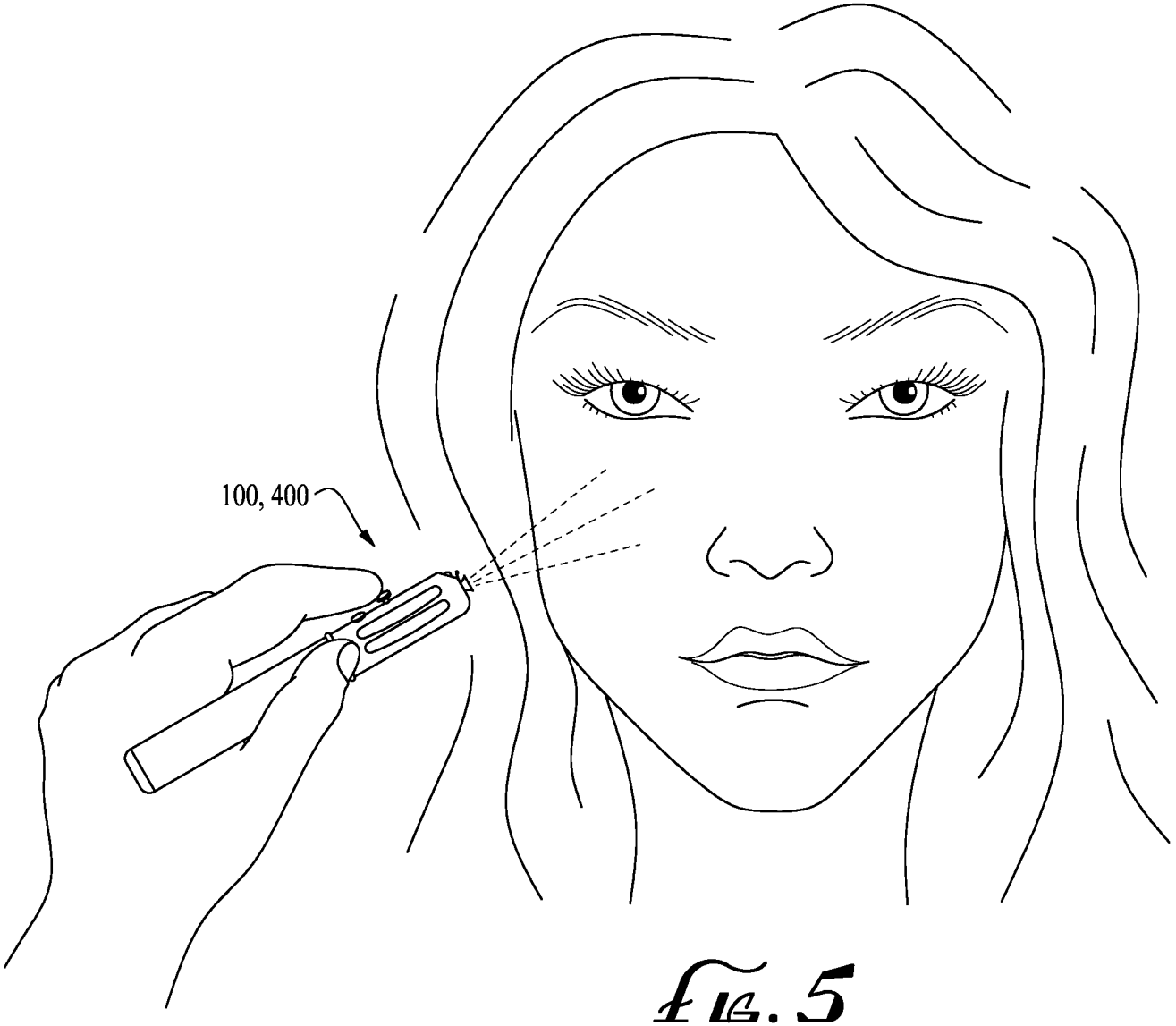
FIG. 5 is a front perspective view of a user using the cosmetic dispenser of FIGS. 1 and 4.

FIG. 5 shows a user using the dispenser 100, 400 of the present invention. Depression of the button 112, 412 allows the user to spray cosmetic onto their face (or any other part of their body they wish to apply cosmetic.

All features shown and described with respect to the first embodiment 100 and the second embodiment 400 are interchangeable with each other and are not limited to their respective embodiment.

A method of using the dispenser 100 of the first embodiment comprises separating the upper portion 104 of the housing 102 from the lower portion 106 of the housing 102, inserting a cosmetic cannister 120 into the upper portion 104 of the housing 102 via end 103, coupling the upper portion 104 of the housing 102 to the lower portion 106 of the housing 102, removing end cap 124 from the lower portion 106 of the housing 102, inserting a gas cannister 122 into the lower portion 106 of the housing 102 such that the air-tight coupler 136 punctures the cannister 122, coupling the end cap 124 to the lower portion 106 of the housing 102, optionally pressing the light button 116 to turn the light 114 on, and then pressing spray button 112 and spraying cosmetic onto the surface the user desires to apply cosmetic.

Optionally, the gas cannister 122 is inserted into the device 100 before the cosmetic cannister 120 is inserted into the device 100.

A method of using the dispenser 400 of the second embodiment comprises separating opening the fluid intake 450 and pouring or squirting cosmetic into the cosmetic compartment 420, closing or removing the fluid intake 450, removing end cap 424 from the housing 402, inserting a gas cannister 422 into the housing 402 such that the air-tight coupler 436 punctures the cannister 422, coupling the end cap 424 to the housing 402, optionally pressing the light button 416 to turn the light 414 on, and then pressing spray button 412 and spraying cosmetic onto the surface the user desires to apply cosmetic.

Optionally, the gas cannister 422 is inserted into the device 400 before the cosmetic is poured/squirted into the cosmetic compartment 420.

The cosmetic dispenser 100, 400 of the present invention has many advantages, including:

- It is compact and can easily fit inside a purse or other carrying bag, such that if a user is out and about and not at home, they can easily apply the cosmetic;
- The user simply pulls the dispenser 100, 400 out of their purse or carrying bag, turns on the light 114 if necessary, and presses the spray button 112 to apply the cosmetic;
- The gas source 122 is compact and compact and replaceable, making the dispenser 100, 400 ideal for use outside the home;
- There is no need to couple to the dispenser 100, 400 to a compressor or other larger gas source;
- The light source 114 also contributes to the on-the-go advantage of the present invention; and
- Known air brush cosmetic applicators are large and not designed for use outside the home or office (in the event the user is a professional make-up artist).

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. A hand-held cosmetic dispenser comprising:

a housing having an upper portion and a lower portion, wherein the upper portion and the lower portion removably couple to each other;

i. the upper portion of the housing having: a nozzle removably coupled thereto; a spray button coupled to the upper portion of the housing; and a cosmetic fluid compartment disposed within the upper portion of the housing and configured to receive and retain a cannister of cosmetic fluid; and ii. the lower portion of the housing having: gas compartment configured to receive and retain a gas cannister; and a gas controlling system disposed within the lower portion of the housing and having a control mechanism that controls how much gas can leave the gas cannister.

2. The dispenser of claim 1, wherein the upper portion and the lower portion of the housing removably couple together via threading or friction.

3. The dispenser of claim 1, wherein the lower portion of the housing has an end cap that removably couples thereto in order to permit insertion and removal of the gas cannister.

4. The dispenser of claim 1, further comprising a power source, wherein the power source is a rechargeable lithium battery.

5. A method of using the dispenser of claim 1 comprises steps of:

a) providing the dispenser of claim 1;

b) separating the upper portion of the housing from the lower portion of the housing;

c) inserting the cosmetic cannister into the upper portion of the housing;

d) coupling the upper portion of the housing to the lower portion of the housing;

e) removing an end cap from the lower portion of the housing;

f) inserting the gas cannister into the lower portion of the housing such that an air-tight coupler punctures the gas cannister;

g) coupling the end cap to the lower portion of the housing; and h) pressing the spray button and spraying the cosmetic fluid onto a surface a user desires to apply the cosmetic fluid.

6. The method of claim 5, wherein step f) is performed before step c).

7. A hand-held cosmetic dispenser comprising a housing having a removably coupled first end and a second end and comprising:

a) a nozzle coupled to the first end of the housing;

b) a spray button coupled to the first end of the housing; and c) a gas controlling system disposed within the second end of the housing and having a control mechanism that controls how much gas can leave at least one gas cannister within the second end of the housing;

wherein the housing is configured receive cosmetic fluid and to removably couple to the at least one gas cannister.

8. The dispenser of claim 7, wherein the second end of the housing comprises a removable end cap that permits coupling of the at least one gas cannister.

9. The dispenser of claim 7, wherein the at least one gas cannister is a cartridge containing pressurized gas.

10. The dispenser of claim 7, wherein the housing comprises a fluid intake coupled thereto for receiving the cosmetic fluid.

11. The dispenser of claim 7, further comprising a power source, wherein the power source is a rechargeable lithium battery.

12. The dispenser of claim 7, wherein the nozzle is removable and interchangeable.

13. A method of using the dispenser of claim 7, the method comprising the steps of:

a) pouring or squirting the cosmetic fluid into the housing;

b) coupling the at least one gas cannister to the housing; and c) pressing the spray button and spraying the cosmetic fluid onto a surface a user desires to apply the cosmetic fluid.

14. A hand-held cosmetic dispenser comprising a housing having a removably coupled first end and a second end and comprising:

a) a spray button coupled to the first end of the housing; and b) a gas controlling system disposed within the second end of the housing and having a control mechanism that controls how much gas can leave at least one gas cannister;

wherein the housing is configured to receive cosmetic fluid and to removably couple to the at least one gas cannister.

15. The dispenser of claim 14, wherein the second end of the housing comprises a removable end cap that permits coupling of the at least one gas cannister.

16. The dispenser of claim 14, further comprising a power source, wherein the power source is a rechargeable lithium battery.

17. The dispenser of claim 16, further comprising a light disposed proximate the first end of the housing and a light button disposed along the housing and coupled the light and the power source.

18. The dispenser of claim 14, further comprising a nozzle that is removable and interchangeable.

19. The dispenser of claim 14, further comprising a nozzle with a nozzle controller mechanically coupled to the nozzle.

20. The dispenser of claim 14, wherein the housing is configured to receive the cosmetic fluid in a cosmetic cannister.

* * * * *